United States Patent [19]

Moore

[11] Patent Number: 4,658,701

[45] Date of Patent: Apr. 21, 1987

[54] SIDE STRIPPING MECHANISM FOR LINKED AMMUNITION

[75] Inventor: Bill Moore, Sepulveda, Calif.

[73] Assignee: Hughes Helicopters, Inc., Culver City, Calif.

[21] Appl. No.: 484,445

[22] Filed: Apr. 13, 1983

[51] Int. Cl.[4] ..... F41D 10/02

[52] U.S. Cl. ..... 89/332; 89/33.25

[58] Field of Search ..... 89/33.01, 33.25, 33.16, 89/33.2

[56] References Cited

U.S. PATENT DOCUMENTS

| | | | |
|---|---|---|---|
| 2,789,474 | 4/1957 | Darsie | 89/33.25 |
| 3,139,796 | 7/1964 | Nutting | 89/33.16 |
| 3,229,584 | 1/1966 | Zehnder | 89/35.01 X |
| 4,015,511 | 4/1977 | Folsom et al. | 89/33.25 |
| 4,038,904 | 8/1977 | Rocha | 89/33.03 |
| 4,290,339 | 9/1981 | Skahill | 89/33.25 |
| 4,506,588 | 3/1985 | Kazanjy | 89/33.25 |

FOREIGN PATENT DOCUMENTS

| | | | |
|---|---|---|---|
| 151647 | 10/1921 | United Kingdom | 89/33.25 |

*Primary Examiner*—John F. Terapane
*Assistant Examiner*—John S. Maples
*Attorney, Agent, or Firm*—Paul T. Loef; Daniel L. Dawes; George W. Finch

[57] ABSTRACT

The side stripping of ammunition from linked ammunition belts in an automatic weapon system is improved by providing a stripping mechanism including a link sprocket for engaging the link belt and rounds and including a synchronously rotating follower guide. A plurality of followers are disposed and slidable within a corresponding plurality of radial slots defined in the follower guide. Two followers are provided for each round which could be accommodated by the link sprocket. The follower slides radially along the slot in the following guide toward and away from its corresponding round as controlled by a cam pin extending from the follower and engaging a cam raceway in an adjacent fixed cam plate. By this means a purely radially force is symmetrically applied to each round through the longitudinal axis of the round and perpendicular to the axis of the sprocket so that no net torque is applied to the round or its corresponding link. Furthermore, the sprocket size and rate of rotation is chosen so that the tangential velocity at handoff of the round to a feed rotor from the link sprocket substantially equals the tangential velocity imparted to the round by the feed rotor which accepts the stripped round and carries the round into a feed mechanism within the automatic weapon system.

10 Claims, 8 Drawing Figures

SIDE STRIPPING MECHANISM FOR LINKED AMMUNITION

BACKGROUND OF THE INVENTION

1. Field of the Invention

The invention relates to the field of automatic guns using belted ammunition and more particularly to stripping mechanisms for removing the ammunition from the ammunition belt with a side thrusting force.

2. Description of the Prior Art

Ammunition is typically handled and loaded into automatic guns and cannons with the use of link belts from which the ammunition is stripped by the feeding or loading mechanism of the automatic gun. Typical examples of such linked belts are shown by Zehnder, "Automatic Firearm Feed Mechanisms", U.S. Pat. No. 3,229,584 and by Skahill, "Cam Actuated Ammunition Pre-Stripping Mechanism", U.S. Pat. No. 4,290,339. However, many prior art mechanisms for stripping ammunition from linked belts provide a push or pull approximately aligned with the longitudinal axis of the round. In other words, a force is applied to the end of the round casing pushing the round from the link across the length or longitudinal axis of the link. Such end stripping mechanisms require some type of pushrod which can exert a force on the round across a distance long enough and far enough to fully displace the round from the link. In addition, the frictional force exerted by the resilient fingers of the link which usually tightly clasp the round, is fairly substantial. Therefore, end strippers tend to be the slowest component of the automatic gun, tend to limit its firing rate, and also tend to require substantial amounts of power to operate.

In an attempt to overcome these shortcomings, various prior art designs have been developed to side strip the ammunition from such belts. Typically, the link enclosing the round is generally C-shaped in cross section and thereby provides resilient fingers as the arms of the "C" which tightly clasp the round. The transverse opening of the C-shaped link provides a means of exit for the round. Various types of mechanisms have been devised for applying a force to the round in order to force the round through the transverse opening of the link. One example of such mechanisms is shown in Darsie, "Means for Stripping Links in a Firearm", U.S. Pat. No. 2,789,474. In Darsie, a fixed spearing cam penetrates a specially designed link through an opening provided along the backbone of the link opposite the transverse opening of the link. The cam surface provides a curved surface against the back of the round so that as the link belt is advanced, the round is urged through the transverse opening of the link by the curved surface of the fixed spearing cam, which surface leads in a direction away from the link while the link continues in a predetermined direction. An additional example of such mechanisms is shown in Rocha, "Cartridge Feed, Positioning and Injection Control System", U.S. Pat. No. 4,038,904 wherein an oscillating finger contacts the back of the round and moves through an open space provided in the link forcing the round from the link or conveyor belt into the breech and then returns to its original position behind the link or belt.

However, each of these mechanisms are still subject to the shortcoming that frictional forces are developed in a direction which does not serve to strip the round from the belt. Generally, such side stripping forces have a component at some point during the stripping operation acting in a direction which does not directly extend through the longitudinal axis of the round. These non-axially aligned forces exert a pressure against the resilient fingers of the C-shaped link and therefore exert a torque on each link at some point in time. The torque causes the link to twist which can sometimes be so severe that the link and the belt will jam within the gun or deform the resilient fingers of the link. The deformed link might then jam within the gun or at least tend to cause the round to be delayed or tilted in an unanticipated direction in the feed mechanism thereby causing the round to possibly jam the gun or interfere with its smooth operation. These complications are particularly aggravated where the stripping force must be applied to the round within a short time interval as in Rocha and thereby tends to be impulsive.

What is needed then is some type of mechanism for side stripping ammunition from linked belts which overcomes each of these shortcomings, namely, which is capable of smoothly removing the round from the belt without twisting the belt or bending and deforming the link.

BRIEF SUMMARY OF THE INVENTION

The invention is an improvement in an automatic weapons system including a stripper mechanism for removing rounds of ammunition from a belt. The improvement comprises a link sprocket mechanism for engaging the belt which includes a plurality of the rounds. A plurality of stripper mechanisms are coupled to the link sprocket mechanism and strip the plurality of rounds from the belt. The stripper mechanisms are characterized by applying a stripping force to each round, which force is aligned at all times through the longitudinal axis of the round.

In the illustrated embodiment, the stripper mechanism includes a plurality of follower mechanisms. Each set of follower mechanisms applies the aligned force to a corresponding one of the plurality of rounds. The automatic weapons system also includes an ammunition feeder for accepting rounds stripped from the belt and for feeding the rounds into the automatic weapon system for firing. The ammunition feeder feeds the rounds into the automatic weapons system at a predetermined initial linear velocity. The link sprocket mechanism imparts the predetermined initial velocity to each round as the stripper mechanism removes the round from the belt and as the round is handed off to the ammunition feeder. The predetermined initial linear velocity of each round as it is handed off by the stripper mechanism from the link sprocket mechanism is substantially equal both in magnitude and in direction to the predetermined initial linear velocity characterizing the ammunition feeder.

Consider now the invention as illustrated in the following drawings.

BRIEF DESCRIPTION OF THE DRAWINGS

The invention and its various embodiments are better understood by considering the above Figures, wherein like elements are referenced by like numerals in connection with the following detailed description.

DETAILED DESCRIPTION OF THE PREFERRED EMBODIMENTS

The invention is an improvement in a side stripping mechanism for an automatic gun wherein ammunition is removed from linked belts by the application of a side stripping force in line with the longitudinal axis of the round and with the link holding the round. The belted ammunition is fed onto a link sprocket which drives the linked belt through the stripping mechanism. The links are held onto the sprocket by a combination of guides which contact the round and by wrapping the belt about the link sprocket by at least half its circumference. The link sprocket is attached to a follower guide in which a plurality of radial slots are defined. A follower, which is adapted to contact and push the round, includes a cam pin and is slidingly disposed in the radial slots in the follower guide. The cam pin travels in a fixed cam path disposed adjacent to the follower guide so that the follower moves inwardly and outwardly along the radial slot in the follower guide as determined by the adjacent fixed cam path. One such follower set is provided for each link position in the link sprocket. Therefore, the follower of each link position rotates with the link sprocket and is constrained by the radial slot in the follower guide to move only in a radial direction along the link sprocket. As the follower moves radially outward it contacts the round, thereby forcing the round outward in a radial direction through the transverse opening in the C-shaped link. A pair of such follower guides, followers and cam paths are provided at each end of the round to simultaneously and synchronously force the round from the link with an in-line axial force applied at each end of the round.

Figure 1:
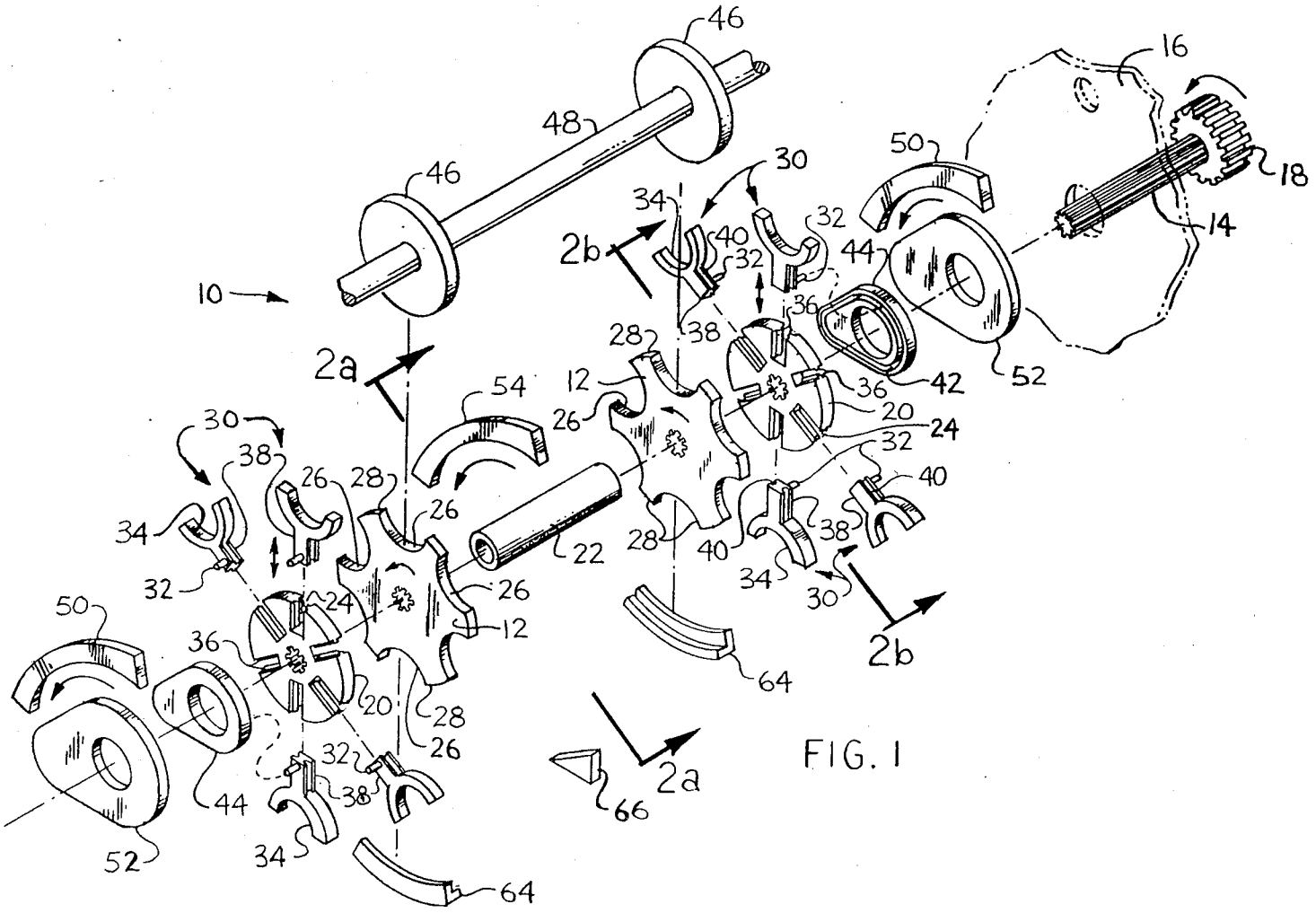
FIG. 1 is a simplified exploded perspective view showing the principal operative elements of the side stripping mechanism.

The invention may be better understood by turning now to FIG. 1 wherein a simplified exploded perspective view of the stripping mechanism, generally denoted by reference numeral 10, is illustrated. Link sprockets 12 are fixed by welding, splines, key slot or other means to a drive shaft 14 rotatably journalled to a frame 16, a rear frame of which is shown in FIG. 1. The front frame has been omitted for the sake of clarity. Drive shaft 14 is coupled to a drive gear 18 which is in turn driven by a conventional means not shown. Typically, a constant speed motor is employed for driving shaft 14 at an approximately uniform angular velocity. Drive shaft 14 is fixed to link sprockets 12 and corresponding follower guides 20. In the illustrated embodiment, two link sprockets 12 are provided each fixed to a corresponding follower guide 20, which may also be fixed to drive shaft 14. Follower guide 20 and link sprocket 12 may be directly fixed to each other or indirectly by virtue of their mutual attachment to shaft 14. The pair of link sprockets 12 and follower guides 20 are separated on drive shaft 14 from each other by a cylindrical spacer 22.

A plurality of radial slots 24 are defined in each follower guide 20. One such radial slot 24 is provided for each link position 26 in link sprocket 12 which is defined between adjacent teeth 28 of link sprocket 12. A plurality of followers 30 are provided for each follower guide 20, and in particular one follower 30 corresponds to each radial slot 24 defined in follower guide 20. Follower 30 includes a cam pin 32 extending therefrom in the direction of the axis of drive shaft 14 and has a contact arm 34 adapted to engage the rounds of ammunition fed through stripper mechanism 10. For the sake of clarity, ammunition rounds in the belt have been omitted from the drawing of FIG. 1 but are shown and described in connection with FIGS. 2*a*, and 4–6 below.

Follower 30 is retained in and has its movement restrained by its corresponding radial slot 24. This can be accomplished by many means. In one embodiment, shoulders 36 are defined along the edges of each slot 24 in which the stem 38 of follower 30 rides. Similarly, a mating groove 40 could be defined in stem 38 of follower 30 for engagement with shoulders 36 of radial slot 24. The means of engagement of follower 30 in slot 24 is described here only by way of example and is not intended to limit the invention or to exclude other means of retention and restraint now known or later devised which could be substituted.

Cam pin 32 of follower 30 extends into an adjacent cam raceway 42 defined in a fixed cam plate, generally denoted by reference numeral 44. Cam plate 44 in turn is fixed or connected to frame 16 and provides the controlling means by which each of the followers 30, corresponding to the adjacent follower guide 20, is controlled with respect to its radial movement and timing within its corresponding radial slot 24. The front frame 16 has been omitted from the front end (as shown) of the stripping mechanism 10 for the purpose of clarity of illustration. However, link sprocket 12, follower guide 20, followers 30, and cam plate 44 are provided in an identical configuration at both ends of stripping mechanism 10 whereby a pair of synchronized followers 30 contact and urge each round from the link, as described in greater detail below in connection with FIGS. 2*a* and 4–6.

Stripping mechanism 10 also includes, as illustrated in FIG. 1, a pair of idler rollers 46 over which the belted ammunition is drawn, which rollers 46 are coupled to an idler shaft 48 connected or journalled as appropriate to frame 16. The operation of rollers 46 in connection with side stripper 10 is again better described in connection with FIG. 2*a* and 4–6 below.

Side stripping mechanism 10 also includes a plurality of fixed guide elements used to passively guide the ammunition and links through stripper mechanism 10. The disposition of guides is symmetrical within mechanism 10. The guides are better illustrated in FIGS. 2*a* and 2*b*. For example, a back guide 50 is fixed relative to back frame 16 and provides a guiding surface to contact the rounds and thereby stabilize their longitudinal position within mechanism 10. In other words, guides 50 will contact the front and back end of each round to provide longitudinal stabilization. Similarly, guide 52 is fixed relative to frame 16 and provides a guiding surface as best shown in FIGS. 1 and 2*b* for supporting and guiding the ballistic end of the rounds as they are pulled through link sprockets 12. An opposing link guide 54 is fixed relative to frame 16 and provides a third guiding surface in the middle of the rounds generally opposite to the points of contact provided by guides 52 so that each round is guided and supported at three points as it is pulled together with the linked belt around link sprocket 12. In addition, more accurate longitudinal positioning of the ammunition belts is provided by link guides 64 (FIG. 1), which provide a contacting, guiding and supporting surface directly to each link as it is fed around and out of link sprockets 12.

Figure 2A:
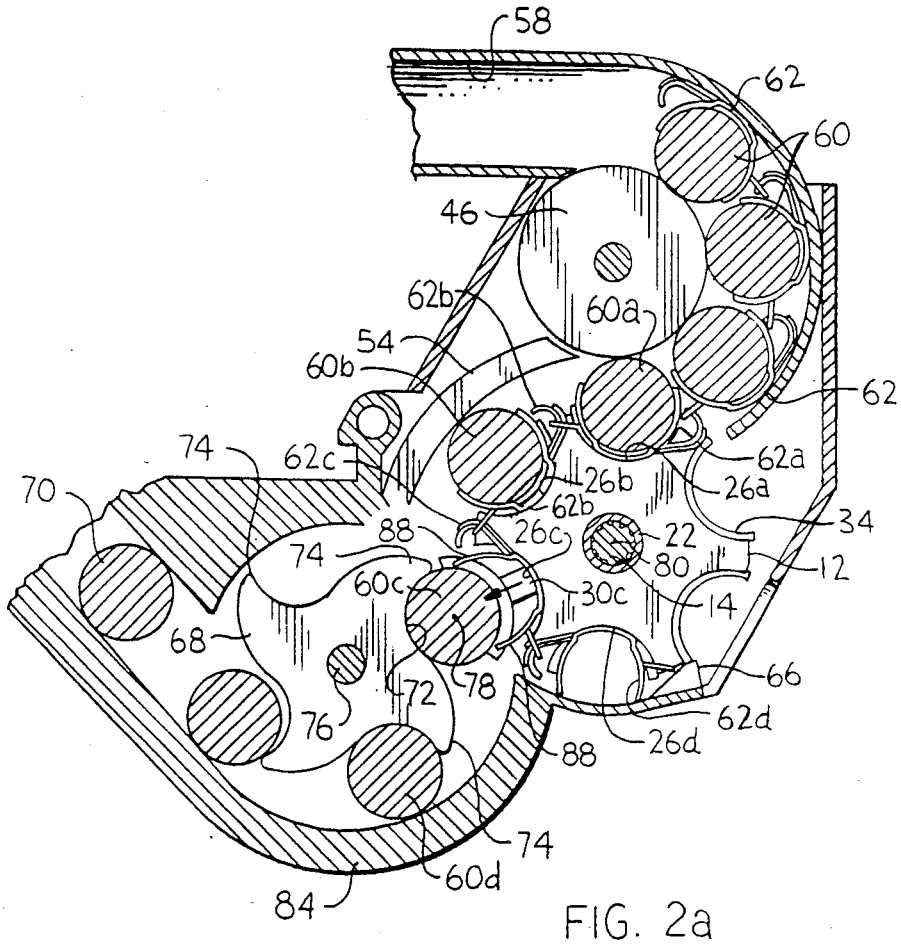
FIG. 2*a* is a diagrammatic elevational view of the assembled invention through line 2*a*—2*a* of FIG. 1.
Figure 2B:
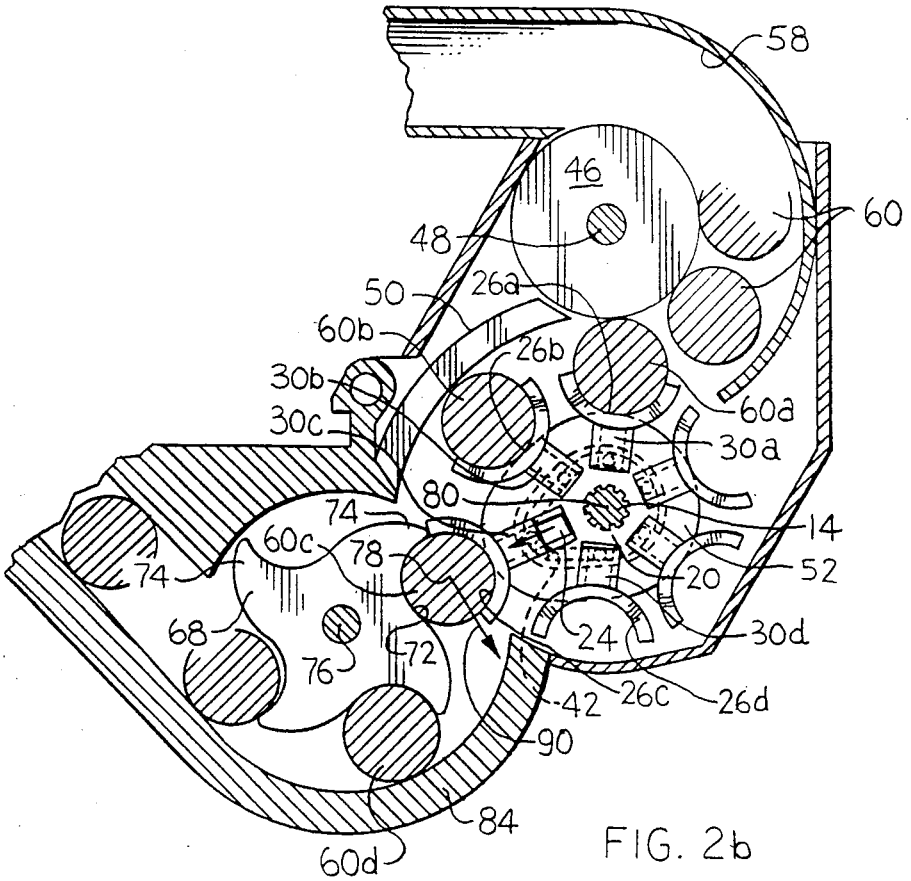
FIG. 2*b* is a diagrammatic elevational view of the assembled invention through line 2*b*—2*b* of FIG. 1.
Figure 3:
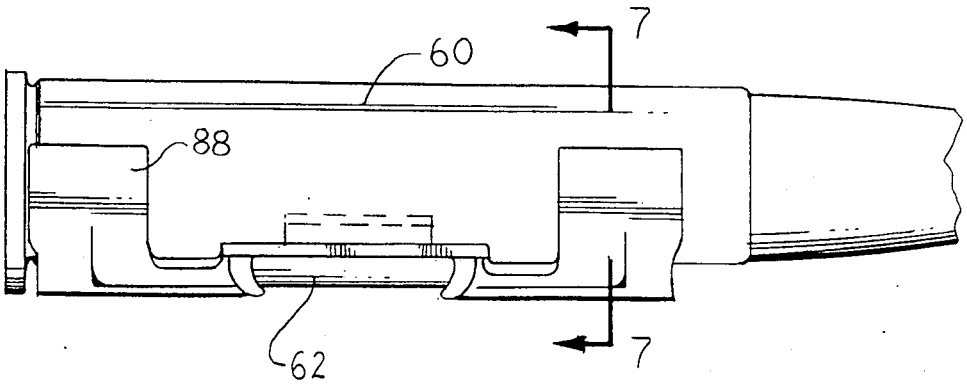
FIG. 3 is a side elevational view of one round disposed in its corresponding link.

Turn now to FIGS. 2*a* and 2*b* which are diagrammatic elevational side views taken through line 2*a*—2*a* and 2*b*—2*b* respectively of FIG. 1 and which graphically illustrate the cooperation of the various elements described above in connection with FIG. 1 to guide, feed and strip the ammunition from the linked belt into the feed mechanism of the gun. Belted ammunition is provided along a conventional ammunition chute 58 which delivers rounds 60 which are flexibly coupled together by links 62. FIG. 3 shows a side elevational view of the link used in side stripper mechanism 10 of the invention. Link 62 is a conventional XM-29 link which is a standard American link for 30 mm rounds. A similar link is built in the United Kingdom and is known as the ADEN link and in France as the DEFA link. Each of these links, even though designed for substantially identical ammunition differs in small respects. Side stripper 10 as described herein can be interchangeably used with any one of the three types of links with equal ease facility and without modification of any kind.

Turning again to FIG. 2, rounds 60 are guided over idler wheels 46 and positioned by guides 50–54 as they move toward engagement with link sprocket 12. Link sprocket 12, in the illustrated embodiment, is provided with six link positions 26*a, b,* etc., the spacing between which is defined by the link pitch, that is the distance between the two points of coupling on a link. Round 60*a,* held by link 62*a,* is fully engaged and seated in the link position 26*a.* Link 62*a* is the first link position (rounds advance from positions a through d of the incoming ammunition belt which engages link sprocket 12. In addition to link 62*a,* three additional links 62*b,* 62*c* and 62*d* are also fully engaged with link sprocket 12. The last link being engaged therewith being link 62*d.* Thereafter, links 62 are separated from each other as they are led off of link sprockets 12 by means of a link guide 64 and conventional link separator 66. The separated links 62 are then either stored in an unlinked condition or disposed of on the site. Thus, by virtue of the guides and coupling between links 62*a*–62*d,* each of the links 62*a*–62*d* are fully seated within their respective link positions 26*a*–26*d* as illustrated in FIG. 2*a.*

Rounds 60*a*–60*d* are handed off to a conventional feed rotor 68 and thence to a breach mechanism and barrel diagrammatically illustrated and referenced in FIG. 2*a* by reference numeral 70. Consider now the handoff procedure in detail. Follower 30*a* corresponding to link 62*a* and round 60*a* is in a fully retracted position as round 60*a* seats at link position 26*a* as best seen in FIG. 2*b.* Round 60*b,* which is seated in linked position 26*b,* is 60° advanced from link position 26*a,* is just beginning to move outwardly, and marks the first point of outward movement of follower 30*b* and the beginning of the hand-off cycle. 60° advanced from link position 26*b* is link position 26*c* wherein round 60*c* is fully seated within a round position 72 defined between teeth 74 of feed rotor 68. In the illustrated embodiment feed rotor 68 is a four-tooth rotor while link sprocket 12 has six teeth. Therefore, the angular rate of velocity at which shaft 14 and link rotor 12 is driven is not the same as that of feed rotor 68, but is chosen so that the tangential velocity of the round then being handed off, namely round 60*c* in FIG. 2*a* and 2*b,* as initially defined by link sprocket 12, is substantially equal to the tangential velocity of round 60*c* as defined by feed rotor 68. At the point of handoff of round 60*c,* the handed-off round, is equally engaged both by feed rotor 68 and by link sprocket 12 through link 62*c.* The point of hand-off is defined as that moment wherein center 76 of feed rotor 68 is in line with center 78 of round 60*c* and with center 80 of link sprocket 12. As shown in FIG. 2*b* follower 30*c* is nearly at its outermost travel along its corresponding slot 24 in follower guide 20 and almost entirely disengaged from link 62*c.* The outermost ends of link 62*c* (FIG. 2*a*) have in fact passed well behind the equator or halfway point of round 60*c* and are beginning to resiliently contract, an action which tends to snap round 60*c* out of link 62*c.*

Follower 30*c,* however, continues to travel radially outward for another 10° of rotation of link sprocket 12 to positively insert and carry round 60*c* into a guided path defined by feed rotor guide 84 and thence to the firing mechanism of the gun. Thereafter, follower 30*c* begins to retract within its corresponding radial slot 24 of follower guide 20 until it reaches a fully retracted position by the time link position 26*c* reaches the point assumed by link position 26*a* as illustrated in FIG. 2*a.* The configuration of maximum extension of follower 30*c* is more directly shown in FIG. 4 wherein link 62*c* has completely released round 60*c* and merely touches the cartridge casing with its ends 82.

Figure 4:
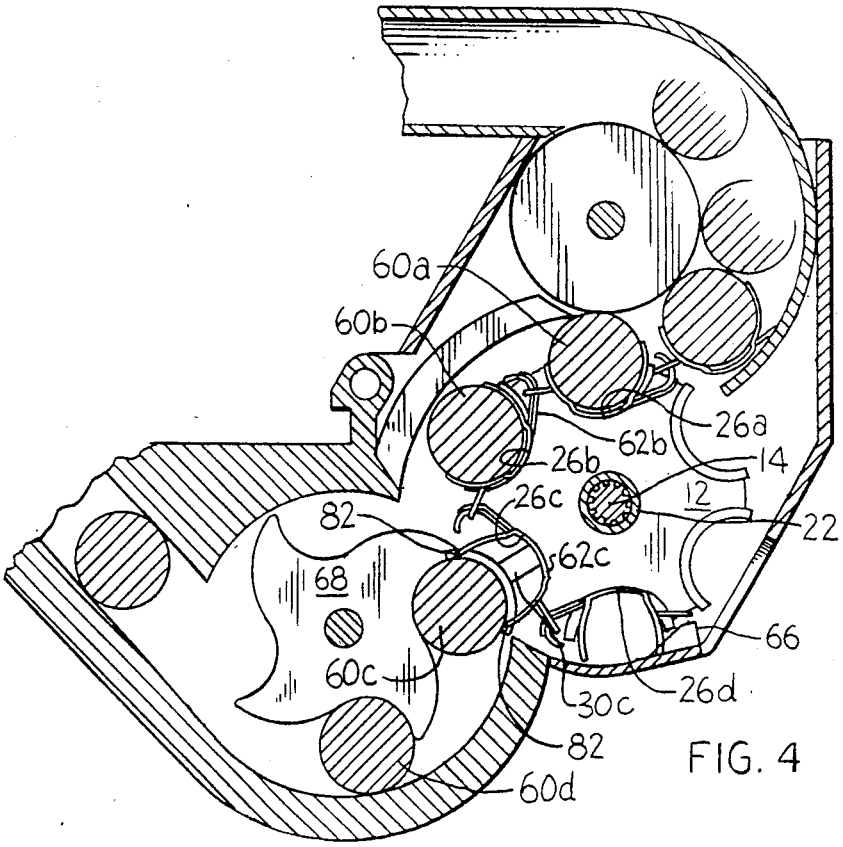
FIG. 4 is the view of FIG. 2*a* after a 10° advance of the stripping mechanism.
Figure 5:
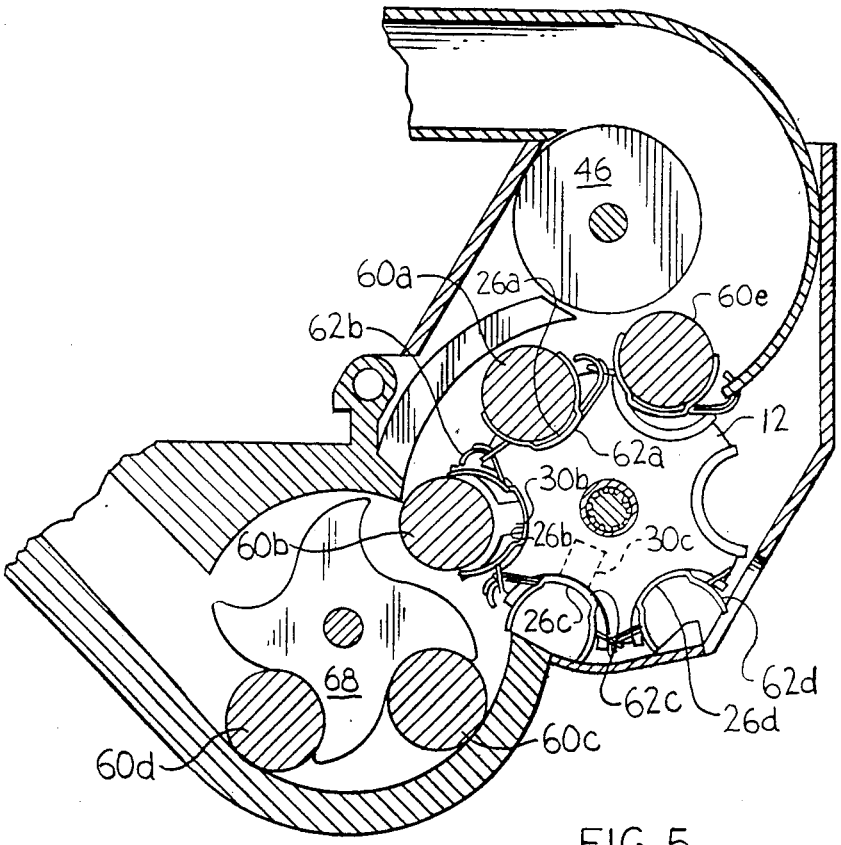
FIG. 5 is the view of FIG. 2*a* after a 40° advance of the stripping mechanism.

FIG. 5 illustrates the relative configuration of the elements shown and described in FIGS. 2*a*–*b* and 4 at a position 40° after the point of handoff shown in FIG. 2*a*–*b* wherein it can be noted that follower 30*c* is well retracted below the position of link 62*c.* Link 62*d* is still fully engaged with link sprocket 12 and thereby serves to keep link 62*c* firmly seated within link position 26*c.* Meanwhile, round 60*b* is approaching the handoff position and will reach the point within another 20° of rotation of link sprocket 12. Follower 30*b* is moving radially outward and has already begun to disengage round 60*b* from its corresponding link 62*b.*

Figure 6:
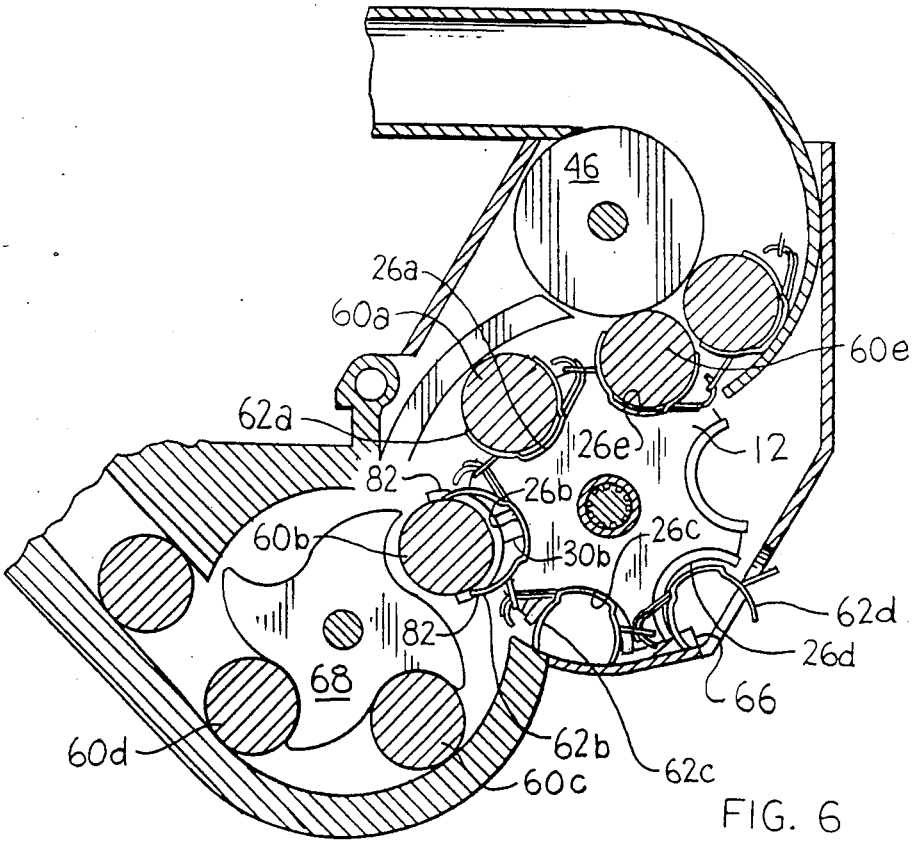
FIG. 6 is the view of FIG. 2*a* after a 50° advance of the stripping mechanism.

FIG. 6 shows the elements of FIGS. 2*a*–*b,* 4 and 5 in the configuration where sprocket 12 has rotated 50° beyond the handoff position illustrated in FIG. 2. Link 62*c* is still firmly and fully engaged in link position 26*c,* round 60*b* is approaching handoff and will soon make contact with feed rotor 68. Follower 30*b* has continued to advance radially outward and has reached the point where it is approximately as radially extended as outermost ends 82 of link 62*b.* Link 62*d* has just begun to lift off link position 26*d* of link sprocket 12. Similarly, a new round 60*e* has been pulled into link position 26*e* and will soon seat within that position. Link 62*d* will be disengaged from link 62*c* by link separator 66 just as it comes off link sprocket 12.

Figure 7:
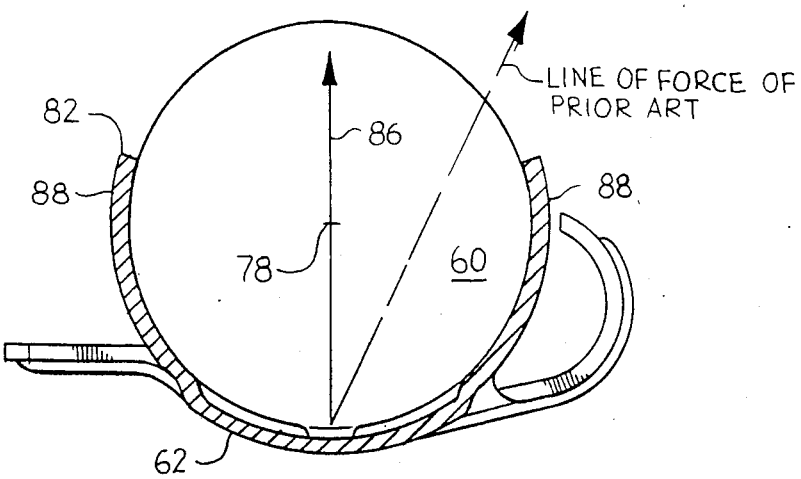
FIG. 7 is a sectional elevational view taken through line 7—7 of FIG. 3.

Consider now the stripping operation collectively depicted in FIGS. 2–6. At each point in the stripping operation a follower 30 is directly behind its corresponding round and when it moves radially outward, is applying a radial force, illustrated in FIG. 7 by vector 86 which is in line with center 78 of round 60. As a result, vector force 86 is symmetrically disposed between arms 88 of link 62. Thus, the stress transmitted to link 62 by vector force 86 is also symmetrical and evenly distributed between both sides 88. Link 62 therefore has no twisting torques applied to it, the friction of arms 88 applied to round 60 is evenly distributed thereby allowing the round to come out smoothly and evenly, with neither side 88 bent nor deformed in the stripping operation.

In addition, according to the invention, round 60 is smoothly handed off from link sprocket 12 to feed rotor 68. In other words, the velocity of the center of the round is a smooth, continuous time function as it proceeds through the side stripper to the feed rotor. The smooth handoff is accomplished by substantially matching the tangential veclocity 90 depicted in FIG. 2*b*, of the center 78 of round 60*c* as it reaches the handoff point. Tangential velocity 90 of round 60*c* is of course equal to the product of the rate of angular rotation of link sprocket 12 times the radial distance to center 78 at the point of handoff. Since the link pitch is a given constant, the size or radius of link sprocket 12 is constrained by the requirement that the circumference of sprocket 12 must accommodate a whole number of links. The radius of link sprocket 12 is thus quantized by the link pitch. An appropriately sized sprocket is then chosen given the range of angular rotation available as a practical matter in the automatic gun in which the stripping mechanism 10 is included. Therefore, it must be clearly understood that the number of link positions 26 in sprocket 12, the size of sprocket 12, and the rate at which it is driven, is chosen in the invention to set tangential velocity 90 at a magnitude most nearly equal to the tangential velocity which feed rotor 68 will impart to a fully seated round at the handoff position. In the illustrated embodiment, both feed rotor 68 and link sprocket 12 thus rotate at constant velocities, although it is within the scope of the invention that variable velocities could be accommodated to effect special purposes.

Turning again to FIG. 2*b*, it can now be readily appreciated that since each round has its own corresponding follower 30 that no sudden acceleration or oscillating movement is required by followers 30 or any other element within stripper mechanism 10. Impact or impulsive forces need not be used and a delinking force may be implied over a greater length of time than that realized by the prior art. For example, in the illustrated embodiment, delinking force is applied beginning at position indicated by link position 26*b* in FIG. 2*b* and continues to a position held by link position 26*c* in FIG. 4, namely, through 70° of rotation of link sprocket 12. Therefore, the force used in the stripping action is expended over a greater period of time with the result that the power draw of stripper mechanism is lower and is much more constant than that experienced in stripper mechanisms using impact or impulsive forces.

Furthermore, rounds 60 are stripped from links 62 without the use of any sliding camming action which typically characterizes prior art side strippers. Most of the frictional force exerted upon round 60 arises from the stripping operation and not from contact with the fixed guides described above in connection with FIG. 1. Therefore, substantially all of the frictional force applied to any round 60 arises only from link 62 since virtually no sliding or frictional force arises between round 60 and follower 30. As described in connection with FIG. 7 above, the sliding frictional force between sides 88 of-link 62 and a round 60 are totally symmetrical so that all such frictional forces exerted on round 60 are not only balanced so that no net torque is applied to round 60, but are in-line with center 78 or parallel to vector 86 depicted in FIG. 7. No net torque is applied to link 62 and hence round 60 may be stripped from link 62 by equally flexing both sides 88. Neither side 88 is deformed beyond its elastic limit or beyond the designed amount.

Many modifcations and alterations may be made by those having ordinary skill in the art without departing from the spirit and scope of the invention. For example, although the illustrated embodiment has been described in connection with a certain round size and certain link design and further has assumed six link positions 26 on link sprocket 12 thereby giving rise to a specific numerical relation between the stripping action and the rotation of link sprocket 12, it must be clearly understood that many alternate types of links, numbers of link positions and angular/timing relationships could have been shown without departing from the scope of the invention. The invention may be aplied to many other types of gun designs, link designs and timing formats.

Therefore, the illustrated embodiment described above has been set forth only for the purposes of example and should not taken as limiting the invention as defined in the following claims.

I claim:

1. An improvement in an automatic weapon system for stripping a plurality of generally cylindrical rounds from a link belt, comprising:

at least one rotating sprocket partially enveloped by an engaging said link belt;

at least one follower guide rotating with said sprocket and having a plurality of radially defined slots;

a follower slideably disposed in each of said slots; and means to drive said follower in said follower guide syncronously with said rotating sprocket so that said follower applies a radial force on said round which acts on a line drawn from the center of said rotating sprocket through the radial center of said round.

2. The improvement of claim 1 wherein said means to drive said follower in said follower guide is a cam plate fixed in relationship to said rotating follower guide and having a cam raceway which engages a cam pin attached to each of said followers.

3. The improvement of claim 1 whereby said follower guide is attached to and aligned with said sprocket.

4. The improvement of claim 1 further comprising guides for aligning and maintaining said link belt in engagement with said sprocket.

5. The improvement of claim 4 wherein said link belt is comprised of a plurality of coupled links and wherein said guides retain at least one of said coupled links on said sprocket after said corresponding round has been removed from said link whereby said next succeeding coupled link maintains its corresponding round in full engagement with said sprocket.

6. An improvement in an automatic weapon system for stripping a plurality of generally cylindrical rounds from a link belt comprising:

at least one rotating sprocket partially enveloped by and engaging said link belt;

at least one follower guide rotating with and about the same center as said sprocket and having a plurality of radially defined slots;

a follower slideably disposed in each of said slots and having a cam pin attached; and at least one cam plate fixed in relationship to said rotating sprocket and having a cam raceway slideably engaging each of said cam pins whereby rotation of said sprocket and said follower guide causes said followers to move radially, ejecting said rounds from said line belt by applying a radial force on said round which acts on a line drawn from the center of said sprocket through the center of said round avoiding torsional loads on said round.

7. An improvement in an automatic weapon system for stripping a plurality of rounds from a belt, each of said rounds being generally cylindrical in shape with a longitudinal axis and retained in said belt by a link partially open on one side and having diametrically opposed support arm ends generally adjacent said opening, comprising:

a rotating sprocket coupled to said belted rounds;

stripper means co-axially rotating in synchronism with said sprocket, said stripper means for removing said rounds from said belt in a timed manner wherein said stripper means further includes: a plurality of followers, a follower guide rotating with said sprocket, a plurality of radially defined slots being defined in said follower guide to accommodate said plurality of followers, a fixed cam plate having a cam raceway defined therein and a cam pin connected to and extending from each of said followers into said cam raceway of said cam plate so that radial movement of each of said followers in said follower guide is determined by guided movement of said cam pin in said cam raceway and one of said plurality of followers corresponding to each round on said belt coupled to said sprocket thereby removing said round from said belt in a radial direction with respect to said sprocket.

8. The improvement of claim 7 wherein said follower guide is attached to and aligned with said sprocket.

9. The improvement of claim 9 wherein said belt is comprised of a plurality of said links coupled together and wherein said stripper means further includes a plurality of guides for aligning and maintaining said links in engagement with said sprocket.

10. The improvement of claim 9 wherein at least one of said coupled links is retained by said guides on said sprocket after said corresponding round has been removed from said link to thereby retain the next succeeding coupled link still including its corresponding round in full engagement with said sprocket.

* * * * *